US009475601B2

(12) United States Patent
Lowry

(10) Patent No.: US 9,475,601 B2
(45) Date of Patent: Oct. 25, 2016

(54) DEVICES FOR CONTAINING MATERIALS AND METHODS OF USING AND MARKING SAME

(71) Applicant: Environmental Resource Associates, Inc., Milford, MA (US)

(72) Inventor: Jeffrey C. Lowry, Golden, CO (US)

(73) Assignee: Environmental Resource Associates, Arvada, CO (US)

( * ) Notice: Subject to any disclaimer, the term of this patent is extended or adjusted under 35 U.S.C. 154(b) by 0 days.

(21) Appl. No.: 14/477,040

(22) Filed: Sep. 4, 2014

(65) Prior Publication Data

US 2014/0367353 A1 Dec. 18, 2014

Related U.S. Application Data

(63) Continuation of application No. 13/123,073, filed as application No. PCT/US2009/059955 on Oct. 8, 2009, now Pat. No. 8,839,970.

(60) Provisional application No. 61/103,948, filed on Oct. 9, 2008.

(51) Int. Cl.

| | |
|---|---|
| ***A61J 1/00*** | (2006.01) |
| ***B65D 1/09*** | (2006.01) |
| ***B65D 41/04*** | (2006.01) |
| ***B65D 17/00*** | (2006.01) |

(52) U.S. Cl.

CPC ..... *B65D 1/09* (2013.01); *B65D 17/02* (2013.01); *B65D 41/04* (2013.01)

(58) Field of Classification Search

CPC ..... A61J 1/00; B65D 1/09; B65D 1/02

USPC ..... 215/47, 247, 249

See application file for complete search history.

(56) References Cited

U.S. PATENT DOCUMENTS

| | | | | |
|---|---|---|---|---|
| 3,907,144 | A * | 9/1975 | Winkler | A61J 1/00 215/44 |
| 5,116,578 | A * | 5/1992 | Baxter | B01L 9/06 141/130 |
| 6,071,477 | A * | 6/2000 | Auclair | G01N 35/04 235/375 |
| 6,174,728 | B1 | 1/2001 | Ben-David et al. | |
| 8,286,671 | B1 * | 10/2012 | Strangis | B65B 7/28 141/104 |
| 2002/0025581 | A1 * | 2/2002 | Schmidt | G01N 35/10 436/180 |

OTHER PUBLICATIONS

International Search Report for PCT/US09/059955 dated Sep. 18, 2009, 3 pages.

Written Opinion for PCT/US09/059955 dated Sep. 18, 2009, 4 pages.

* cited by examiner

*Primary Examiner* — King M Chu

(74) *Attorney, Agent, or Firm* — Waters Technologies Corporation

(57) ABSTRACT

Embodiments of the present invention feature devices and methods for containing one or more compounds. The inventions feature devices having an ampoule-like closure to preserve the integrity of materials contained therein with vial-like features to allow closure after opening. The devices are sized to be received in a tray or carousal of an autosampler.

25 Claims, 3 Drawing Sheets

DEVICES FOR CONTAINING MATERIALS AND METHODS OF USING AND MARKING SAME

CROSS-REFERENCE TO RELATED APPLICATIONS

This application is a continuation of U.S. application Ser. No. 13/123,073 filed on May 11, 2011, which is the National Stage of International Application No. PCT/US2009/059955 filed on Oct. 9, 2009, which claims priority to an benefit of U.S. Provisional Application No. 61/103,948, filed Oct. 10, 2008. The entire contents and teachings of each of these applications are hereby expressly incorporated herein by reference in their entirety.

STATEMENT REGARDING FEDERALLY SPONSORED RESEARCH OR DEVELOPMENT

The inventions of the present application were not made with Federal or state Funds or grants.

THE NAMES OF THE PARTIES TO A JOINT RESEARCH AGREEMENT

The inventions of the present application were not made under a joint research agreement.

REFERENCE TO SEQUENCE LISTING

The present application does not have any nucleic acid, peptide or protein sequence.

BACKGROUND OF THE INVENTION

To facilitate an understanding of the present invention, certain words and phrases will be defined. An "analyte" is a compound that is of interest in the sense that one desires to detect its presence or absence or the quantity in a sample. The term "sample" is used in a broad sense to denote any material, solution, mixture, compound, whether gas, liquid or solid that one may wish to investigate. Samples may be of biological or non-biological in origin. Biological samples may comprise tissues or fluids.

The term "instrument" is used in a broad sense to denote a device for processing samples used for analytical or diagnostic purposes. Such instruments are used in the veterinary, medical and forensic fields and as a research tool. For the purpose of this discussion, the instruments, in a simple form, will commonly have a carousel or tray for receiving samples, means for removing an aliquot of the sample, and a detector. An autosampler is a component of an instrument or a separate instrument used with a detector and separation equipment. A typical autosampler will comprise a receiving assembly for receiving a tray or carousal. The tray or carousal will have samples in the form of vials containing liquids to be analysed. A sample needle descends into the vial and withdraws an aliquot of sample. This aliquot is directed to the separation equipment and detector. Autosampler typically receive specific trays or carousals. These trays and carousals position standard vials in a position relative to the sample needle such that the vial and fluids contained therein are positioned for the needle to withdraw the aliquot. A vial is a cylindrical vessel having a threaded opening on the top to receive a cap. The cap closes the vial.

A "standard" is a material, such as a known compound in a solution of a known solvent, to which a comparison is made. The comparison may facilitate identification of a compound, quantification of a compound or to facilitate calibration of an instrument, detector or the like. Standards are available commercially in ampoules. These standards are often to be reconstituted when needed or are preformed.

An ampoule is a vessel, cylindrical in shape having a first section for holding fluids or materials for reconstitution and a breakable seal section or neck. Ampoules are typically made of glass. The breakable seal section closes the first section and is typically denoted by a score in the glass material from which it is made. A user firmly grasps the first section in one hand and snaps the breakable seal section away from the first section with the other hand to open the ampoule. Ampoules are convenient for storage of standard materials but are poorly suited to preserve the standard materials once opened. There are no convenient ways in which an open ampoule can be closed. Ampoules are typically not sized to be received in trays and carousals of autosamplers. Standard materials are typically manually transferred from the ampoule to a vial that fits a type of autosampler in use. Such handling can give rise to error and decreases productivity.

It would be useful to have a device for containing fluids having an ampoule-like closure to preserve the integrity of standard materials and capable of being received in a tray or carousal of an autosampler.

SUMMARY OF INVENTION

Embodiments of the present invention feature devices and methods for containing one or more compounds. The inventions feature device having an ampoule-like closure to preserve the integrity of materials contained therein and can be sized to be received in a tray or carousal of an autosampler.

One embodiment of the present invention directed to a device comprises a body having an interior surface and an exterior surface. The interior surface and exterior surface define a first section, securing means and breakable seal section. The interior surface at said first section defines a chamber for containing a solution. At least one of the interior surface and exterior surface has lip means for receiving a cap seal. At least one of the interior surface and exterior surface associated with the securing section has a securing means for receiving a cap in cooperation with the lip means. The breakable seal section projects from the first section and has a preformed break line which upon application of force on the breakable seal section cleaves from said first section and creates an opening to said chamber surrounded by said lip means to allow closure with a cap.

Thus, embodiments of the present invention feature the advantages of a ampoule with features of a vial. Such embodiments are ideally suited for storing standards and calibration materials.

As used herein, the term "securing means" refers to cooperation threads, interfitting grooves and recesses, locking cam devices, and clamps. As used herein, the term "lip means" refers to a substantially rigid edge aligned in a plane and specifically excludes the edge created upon severing the breakable seal section from the first section.

A preferred embodiment further comprises a cap. The cap has cap securing means and a cap seal. The cap securing means cooperates with the securing means of the body to secure the cap to the first section and the seal upon the lip means after the breakable seal section is cleaved. The cap seal cooperates with the lip means to close the chamber of the first section. A preferred cap has a self sealing injector needle port for receiving an autosampler needle.

Preferably, the first section is constructed and arranged to cooperate with a holder. As used herein, the term "holder" refers to a tray or a carousal or equivalent structure normally received in an autosampler. Thus, an autosampler can receive the device and process the device as it would any other sample. That is, the first section is constructed and arranged to receive a sample needle of an autosampler.

The device can be received in an autosampler with or without a cap with a self sealing needle port. Where the device is used without such cap the tip, preferably, receives a sealing member of the autosampler. Some autosamplers are equipped with a sealing member in the form of a gasket to cooperate with the lip of a vial to place gas in the vial as the fluid is withdrawn through the needle Preferably, at least one of the first section, securing section and breakable seal section of the body is made of glass. And, even more preferably, the body is a unitary structure comprising glass.

Preferably, the breakable seal section is an ampoule section. As used herein, the term "ampoule section" refers to an ampoule tip formed by tip sealing or by pull sealing or by other means. The lip means may be formed by the cleavage of the breakable seal section from the body, with the separation of the breakable seal area creating a lip at the opening of the body. Preferably, the lip means comprises a lip integral with the first section and projecting beyond the break line to allow a cap with a substantially planar seal to be received on the lip.

Embodiments of the present device are ideally suited for containing standards and calibration media. The ampoule-like features preserve the standard and/or calibration media and the vial-like securing section permits the device to be re-closed. The first section, sized to a tray or carousal of an autosampler allows for direct sampling from the device.

A further embodiment of the present invention features a method for containing one or more compounds. The method comprises the steps of providing a device having a body. The body has an interior surface and an exterior surface defining a first section, securing section and breakable seal section. The interior surface at said first section has a chamber for containing a solution and at least one of said interior surface and exterior surface has lip means for receiving a cap seal. The securing section is for receiving a cap and attached to the first section for cooperation with a cap. The breakable seal section projects from the first section and has a pre-formed break line which upon application of force on the breakable seal section cleaves from the first section and opens the first section chamber. The method further comprises the step of placing a solution in the chamber which solution is secured by the breakable seal section. And, upon breakage of the breakable seal section the solution is accessible.

Preferably, the method further comprises the step of providing a cap. The cap has cap securing means and a cap seal. The cap securing means cooperates with the securing section to secure the cap to the lip means after the breakable seal section is cleaved. The cap seal cooperates with the lip means to close the chamber. The method further comprises the step of securing a cap to the lip means after the breakable seal section is cleaved. Or, allowing an autosampler sample needle to interact with the lip means to facilitate extraction of the sample held in the chamber. A preferred sample is a solution containing standards or calibration media.

Preferably, the breakable seal section is an ampoule section, which ampoule section. And, the method comprises the step of breaking the ampoule section from the first section to open the chamber. The lip means is formed upon breaking the ampoule section or allows the cap to seat on an existing lip once the ampoule section is removed.

Preferably, the securing section and the cap securing means are selected from the group consisting of cooperating threads, cooperating flange and grooves, cam locking mechanisms and C-clamps. And the method comprises the step of securing the chamber by placing said cap on the securing means.

These and other features and advantages will be apparent to those skilled in the art upon viewing the drawings and reading the detailed discussion that follows.

DETAILED DESCRIPTION OF THE INVENTION

Embodiments of the present invention will be described in detail as devices and methods for containing one or more compounds. The devices and methods of the present invention have great utility, in particular, for containing solutions of standards and calibration media. In chemical analysis, standards and calibration media are used to adjust instruments or to facilitate identification of certain analytes. However, those skilled in the art will readily understand that the present devices and methods have broad utility and can be used wherever it is desired to maintain the integrity of a solution contained therein, gain access to such solution and effect closure.

Figure 1:
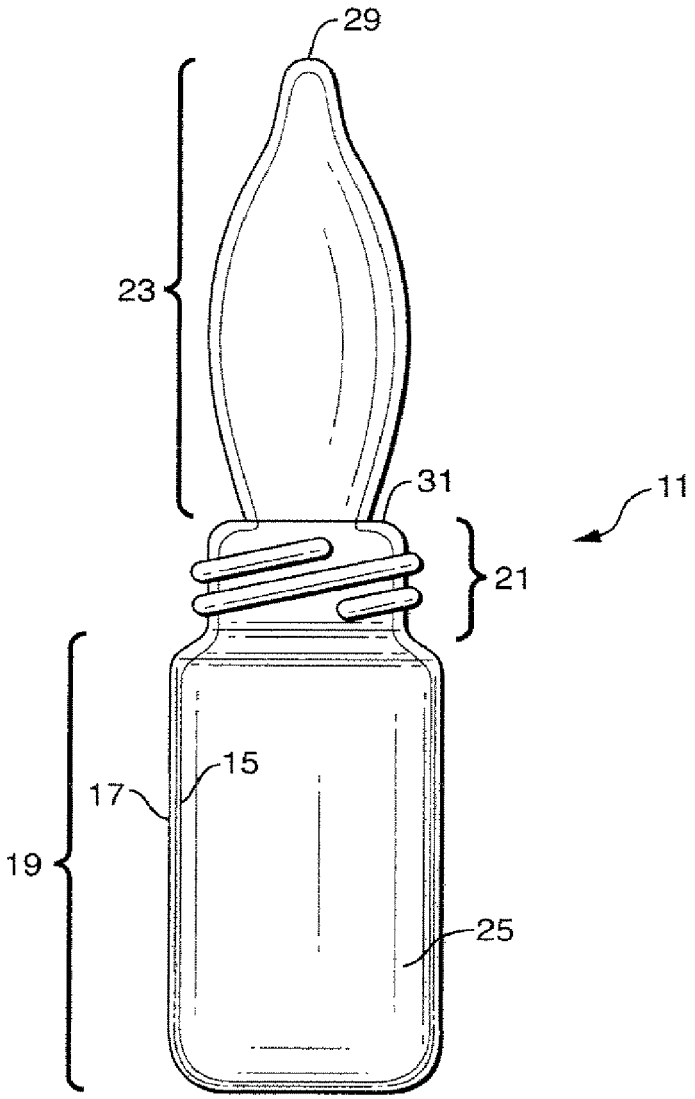
FIG. 1 depicts a device embodying features of the present invention.

One embodiment of the present invention directed to a device, generally designated by the numeral 11, is depicted in FIG. 1. The device 11 has a body 13, generally cylindrical in shape, and having an interior surface 15 and an exterior surface 17. The interior surface 15 and exterior surface 17 define a first section 19, securing means 21 and breakable seal section 23. The first section 19 is proximal to the securing section 21 and distal to the breakable seal section 23. The body 13 can be made of any material commonly used for containment devices including metal, plastic, ceramic and glass or combinations thereof. As depicted, the device 11 is made as a unitary body 13 comprised of glass in the manner of an ampoule.

The interior surface 15 at said first section 19 defines a chamber 25 for containing a solution [not shown]. The solution would normally be placed in the chamber 25 of a device 11, through an opening [not shown] at the top 29 of the breakable seal section 23. This opening is closed, by tip or pull sealing in a manner understood by individuals skilled in the art of glassware manufacturing understand tip and pull sealing. This closure in glassware is substantially permanent and irreversible. Standards and calibration media are sealed by the closure and are not subject to atmosphere other than the atmosphere contained in the chamber 25, evaporative effects or other potential contaminants. The atmosphere in the chamber 25 can be selected to be relatively inert.

At least one of the interior surface 15 and exterior surface 17 has lip means 31 for receiving a cap seal, which will be discussed in greater detail later. As depicted, the lip means 31 comprises a rim along the exterior surface 17 at about the plane separating the securing section 21 from the breakable seal section 23. However lip means 31 may assume other forms as will be discussed later.

At least one of the interior surface 15 and exterior surface 17 associated with the securing section 21 has a securing means 33 for receiving a cap which will be described later. Securing means 33 may take several forms such as threads, as depicted to cooperate with corresponding threads in a cap, interfitting flange and grooves, cam locking mechanisms and c-clamps and circle clips. Although described herein as a unitary structure, features associated with securing means, such as threads, as depicted to cooperate with corresponding threads in a cap, interfitting flange and grooves, snap fitting rims, cam locking mechanisms and c-clamps and circle clips grooves, may be welded or glued or secured in any manner.

The breakable seal section 23 projects from the first section 19 and or the securing section 21. As depicted, the breakable seal section 23 extends from the securing section 21. The breakable seal section 23 has a preformed break line at or about the lip means 31. Upon application of opposing force on the breakable seal section 23 and first section 19, the breakable seal section 23 cleaves from the first section 19 and the securing section 21. This opposing force is generally applied by a user by placing a thumb near the break line and pulling back with fingers around the breakable seal section 23.

Figure 2:
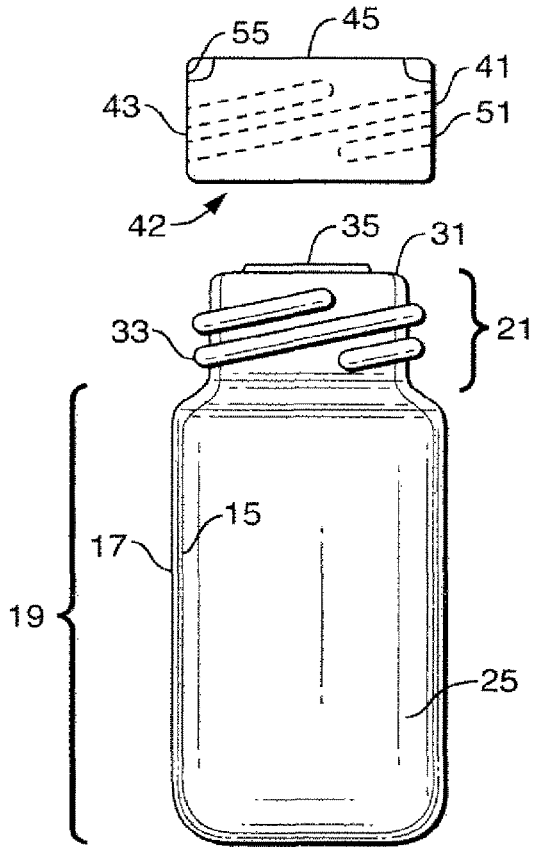
FIG. 2 depicts a device, depicted in cross section, embodying features of the present invention.

The cleavage of the breakable seal section 23 and creates an opening 35, as best seen in FIG. 2, to the chamber 25. The opening 35 is surrounded by the lip means 31. As depicted, lip means 31 is directed to a substantially rigid edge aligned in a plane. Lip means 31 is a rim of the vessel comprised of the first section 19 and the securing section 21 of body 13 created by the removal of the breakable seal section 23. The edge created upon severing the breakable seal section 23 from the first section.19 and the securing section 21 is normally not stable to allow sealing with a cap structure. Lip means 31 may be positioned distal to the breakable seal 23 along any point in the interior surface 15 or exterior surface 19 of the body 13 associated with the securing section 21 or the first section 19.

As depicted in FIG. 2, an embodiment further comprises a cap 41. The cap 41 is cylindrical in shape and has at least one cylindrical wall 43 and one end wall 45. Cap 41 is normally made of plastic but can be made of any material such as metals and ceramics.

Cylindrical wall 43 and end wall 45 define a cap recess 47 for receiving the securing section 21 of body 13. Cap 41 has cap securing means 51 in the form of corresponding threads to body 13. However, other securing means may be readily substituted by those skilled in the arts such as, by way of example, without limitation, interfitting flange and grooves, snap fitting flanges which lock to rim structures, cam locking mechanisms and c-clamps and circle clips [not shown].

The cap 41 has a cap seal 55. The cap seal 55 is a flat planar sheet of resilient material sized and shaped to receive and abut against the lip means 31 of the body 13 to close the chamber 25 of the first section 19.

Figure 3:
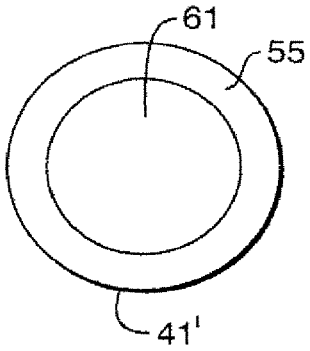
FIG. 3 depicts a cap having features of the present invention.

A further embodiment of the present invention is depicted in FIG. 3, which shows a cap 41' having a end wall 45 having a self sealing injector needle port 61 for receiving an autosampler needle [not shown].

Figure 4:
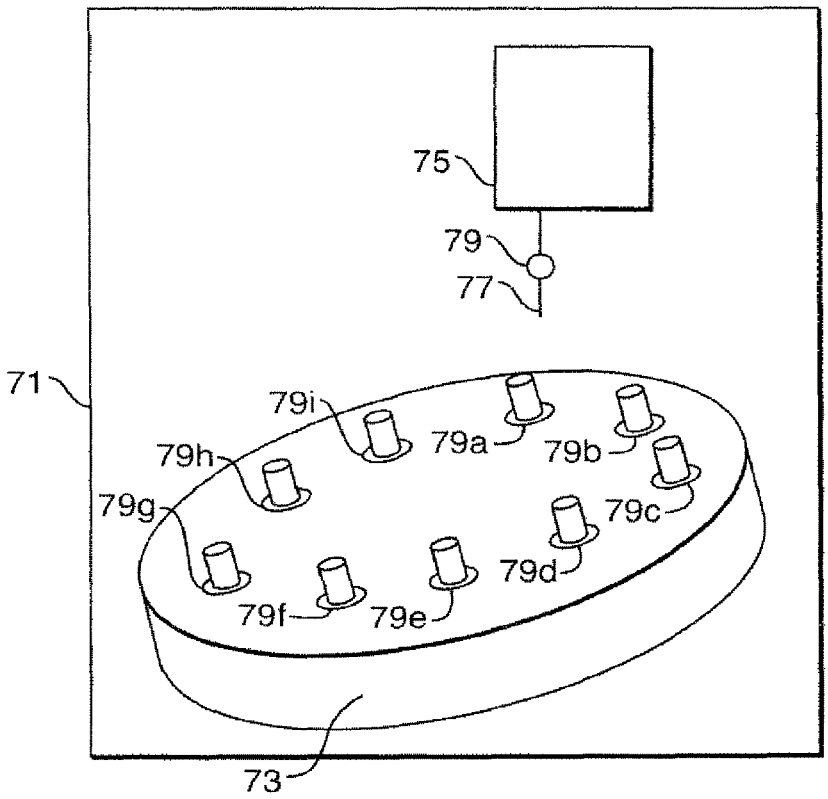
FIG. 4 depicts a autosampler and device embodying features of the present invention.

Features described with respect to the cap 41 may be incorporated in autosampler components in which the first section 19 and securing section 21 of body 13 are received. Turning now to FIG. 4, an autosampler generally designated by the numeral 71 is depicted in schematic form. Autosamplers of the type depicted are well known in the art and are available as components or independent modules from several venders.

The autosampler 71 has a holder 73 and a sample needle mechanism75. The holder 73 is in the form of a tray or carousal. Trays and carousals are typically removable to allow the operator to load the carousal or tray with vials containing samples or standards or calibration media. The autosampler 71 coordinates the movement of the sample needle mechanism 75 and the movement of the carousal, tray or holder 71 to allow the needle mechanism 75 to descend and place the needle 77 into solutions contained in the vials.

As depicted, the holder 73 has a plurality of ports **79*a*-1 for holding vials. The device 11 is sized to be retained at least one of ports 79*a*-*i*, as such holder 73 would retain a vial. The sample needle 77 has a seal 79 received on lip means 31 for sealing the chamber 25 and allowing the needle 77 to place gas into the chamber 25 to facilitate movement of fluids. The needle seal 79 has similar features as cap seal 55 to cooperate with the lip means 31**.

In the alternative, the body 13 with the breakable seal section 23 removed may be received without any needle seal 79. Or, in a further embodiment, body 13 with the breakable seal section 23 removed may be fitted with cap 41' having a resealable needle port 61.

Thus, the device 11 features a vessel with an ampoule-like closure to preserve the integrity of materials contained therein. The device 11 is sized to be received in a tray or carousal of an autosampler such that the user does not need to transfer fluids from an ampoule to a vial. The device 11 has securing means 33 and a lip means for receiving a cap 41 and cap seal 55 to hold the solutions for additional processes and procedures.

Embodiments of the present invention feature the advantages of an ampoule with features of a vial. Such embodiments are ideally suited for storing standards and calibration materials.

A further embodiment of the present invention directed to a method for containing one or more compounds will be described in relationship to the use of the device 11. Returning now to FIG. 1, the method comprises the steps of providing a device 11 having a body 13. The body 13 has an interior surface 15 and an exterior surface 17 defining a first section 19, securing section 21 and breakable seal section 23. The interior surface 17 at the first section defines a chamber 25 for containing a solution. And now referring to FIG. 2, at least one of the interior surface 15 and exterior surface 17 has lip means 31 for receiving a cap seal 55. The securing section 21 is for receiving a cap 41. The breakable seal section 23 projects from the first section 19 and securing section 21 and has a preformed break line which upon application of force cleaves from the first section 19 and securing section 21 and opens the chamber 25.

The method further comprises the step of placing a solution in the chamber 25 which solution is secured by the breakable seal section 23. And, upon breakage of the breakable seal section 23 the solution is accessible.

A method of the present invention further comprises the step of cleaving the breakable seal section 23 from the first section 19 and securing section 21 of the body 13. The body 13 is preferably fitted with a cap 41. The cap 41 has cap securing means 43 and a cap seal 55. The cap securing means 43 cooperates with the securing section 21to secure the cap 41 to the lip means 31 after the breakable seal section 23 is cleaved. The cap seal 55 cooperates with the lip means 31 to close the chamber 25.

Referring now to FIG. 4, the body 13 is preferably size to a autosampler holder in the form of a vial tray or carousal. Standards and calibration media contained in the chamber 25 do not need to be removed and placed in separate distinct vials because the device can be directly received in the holder 73 of an autosampler.

Thus, the preferred embodiments of the present invention have been described with the understanding that the descriptions herein can be altered and modified without departing from the teaching. Therefore, the present invention should not be limited to the precise details set forth herein but should encompass the subject matter of the claims that follow and their equivalents.

What is claimed:

1. A device for containing one or more compounds comprising:

a body having an interior surface and an exterior surface, said interior surface and said exterior surface defining a first section, a securing section and a breakable seal section, said interior surface at said first section defining a chamber for containing a solution said securing section for cooperation with a cap, said breakable seal section projecting from a planar end surface of said first section and having a preformed break line which upon application of force on the breakable seal section cleaves from said first section to form an opening into said chamber of said first section, said planar end surface extending from said opening to said securing section and comprising a lip surrounding said opening.

2. The device of claim 1 further comprising a cap, said cap having cap securing means and a cap seal, said cap securing means cooperating with said securing section of said vessel to secure said cap to said first section lip after said breakable seal section is cleaved, said cap seal cooperating with said lip to close said chamber of said first section.

3. The device of claim 1 wherein said first section is constructed and arranged to cooperate with a holder.

4. The device of claim 3 wherein said holder is a tray or carousal of an autosampler.

5. The device of claim 4 wherein said first section is constructed and arranged to receive a sample needle of an autosampler.

6. The device of claim 4 wherein said lip receives a sealing member of said autosampler.

7. The device of claim 1 wherein at least one of said first section, securing section and breakable seal section of said body is made of glass.

8. The device of claim 1 wherein said securing section and said cap securing means are selected from the group consisting of cooperating threads, cooperating flange and grooves, cam locking mechanisms and C-clamps.

9. The device of claim 1 wherein said securing means comprise threads on the exterior of said body.

10. The device of claim 1 wherein said breakable seal section is an ampoule section.

11. The device of claim 1 wherein said lip comprises the cleavage of said breakable seal section from said body, said separation of said breakable seal area creating said lip at the opening of said body.

12. The device of claim 1 wherein said lip is integral with said first section and projects beyond the break line to allow a cap with a substantially planar seal to be received on the lip.

13. The device of claim 1 wherein said first section contains one or more standards.

14. A method for containing one or more compounds comprising the steps of providing a body having an interior surface and an exterior surface said interior surface and said exterior surface defining a first section, a securing section and a breakable seal section, said interior surface at said first section having a volume for containing a solution, said securing section for cooperation with a cap, said breakable seal section projecting from a planar end surface of said first section and having a preformed break line which upon application of force on the breakable seal section cleaves from said first section to form an opening into said first section volume, said planar end surface extending from said opening to said securing section and comprising a lip surrounding said opening; placing a solution in said volume which solution is secured by said breakable seal section, and upon breakage of said breakable seal section said solution is accessible.

15. The method of claim 14 further comprising the step of providing a cap, said cap having cap securing means and a cap seal, said cap securing means cooperating with said securing section of said body to secure said cap to said first section lip after said breakable seal section is cleaved, said cap seal cooperating with said lip to close said first section volume; said method further comprising the step of securing a cap to said lip means after said breakable seal section is cleaved.

16. The method of claim 15 wherein first section is constructed and arranged to cooperate with a holder.

17. The method of claim 16 wherein said holder is a tray or carousal of an autosampler.

18. The method of claim 17 wherein said first section is constructed and arranged to receive a sample needle of an autosampler.

19. The method of claim 18 wherein said lip receives a sealing member of said autosampler.

20. The method of claim 15 wherein at least one of said first section, securing section and breakable seal section of said body is made of glass.

21. The method of claim 15 wherein said securing section and said cap securing means are selected from the group consisting of cooperating threads, cooperating flange and grooves, cam locking mechanisms and C-clamps.

22. The method of claim 15 wherein said securing means comprise threads on the exterior of said body.

23. The method of claim 15 wherein said breakable seal section is an ampoule section.

24. The method of claim 15 wherein said lip comprises the cleavage of said breakable seal section from said body, said separation of said breakable seal area creating said lip at the opening of said body.

25. The method of claim 15 wherein said lip is integral with said first section and projects beyond the break line to allow a cap with a substantially planar seal to be received on the lip.

* * * * *